United States Patent [19]

Süess et al.

[11] Patent Number: 4,899,558

[45] Date of Patent: Feb. 13, 1990

[54] LABORATORY APPARATUS FOR A WET TREATMENT OF TEXTILE MATERIALS

[75] Inventors: Josef Süess, Reussbühl; Werner Wyss, Eich, both of Switzerland

[73] Assignee: Ahiba AG, Dietlikon, Switzerland

[21] Appl. No.: 233,238

[22] Filed: Aug. 17, 1988

[30] Foreign Application Priority Data

Aug. 20, 1987 [CH] Switzerland ..... 340/87

[51] Int. Cl.[4] ..... D06B 5/18

[52] U.S. Cl. ..... 68/15; 68/189

[58] Field of Search ..... 68/15, 189

[56] References Cited

U.S. PATENT DOCUMENTS

| | | | |
|---|---|---|---|
| 774,407 | 11/1904 | Venter | 68/189 |
| 2,342,183 | 2/1944 | Dunn et al. | 68/189 X |
| 2,845,787 | 8/1958 | Fick | 68/189 |
| 3,165,910 | 1/1965 | Thies | 68/189 X |
| 3,360,968 | 1/1968 | Swindall et al. | 68/189 |
| 3,756,045 | 9/1973 | Felber | 68/189 |
| 4,217,768 | 8/1980 | Sugimoto | 68/189 X |

FOREIGN PATENT DOCUMENTS

| | | | |
|---|---|---|---|
| 2208117 | 8/1973 | Fed. Rep. of Germany | 68/189 |
| 320694 | 9/1934 | Italy | 68/189 |
| 922289 | 3/1963 | United Kingdom | 68/189 |

*Primary Examiner*—Philip R. Coe

*Attorney, Agent, or Firm*—Ladas & Parry

[57] ABSTRACT

A specimen carrier is located in a clearly defined flow path of a treatment liquid in a treatment chamber. This treatment chamber is integrated with a conveying unit to one structural unit. For a realistic representation of the treatment operation the conveying unit comprises a pump having a rotating conveyor part for generating a non-pulsating flow. This flow can thereby be reversed by a reversal of the sense of rotation of the conveying part.

18 Claims, 4 Drawing Sheets

LABORATORY APPARATUS FOR A WET TREATMENT OF TEXTILE MATERIALS

BACKGROUND OF THE INVENTION

1. Field of the Invention

The present invention relates to a laboratory apparatus for a wet treatment of textile materials, including a specimen carrier being located in an exactly defined path of flow of a treatment liquid in a treatment chamber which in turn is integrated with a structural unit a conveying unit for the treatment liquid.

The application of such laboratory apparatuses is to examine and influence the physical and technical parameters of a treatment procedure by scientific methods prior to using such on a large technical scale.

2. Description of the Prior Art

A laboratory apparatus of the kind set forth above is disclosed the Swiss patent specification CH-PS 538 303 which apparatus comprises a treatment liquid conveying means which includes two conveying chambers which are open at two opposed sides and are closed towards the outside by two conveying membranes which are driven synchronously and oscillatingly in the same sense.

Such conveying means allows a circulating of the treatment liquid without any losses due to leakage and without contamination by particles produced by wear.

The design leads, however, positively to the pulsating flow of the treatment liquid which is unsatisfactory regarding a treatment procedure which should represent a realistically practical procedure for technically large scale operations.

Quite often, such test runs to not lend themselves to reproduction.

Furthermore, a reversing of the direction of flow of the treatment liquid is possible only by means of a additional use of a reversing valve which influences detrimentally the flow delivery capacity, the dead or clearance, respectively volume as well as the costs.

A further drawback is created by the fact that the delivery or conveying, respectively, capacity of such a conveying means—considering the small dimensions demanded in a laboratory—under certain conditions cannot satisfy the prevailing demands made. A mere enlargment of the conveying spaces leads additionally to a worsening of the base relation which contradicts again the desire of a laboratory apparatus which produces realistic and reproducible results.

SUMMARY OF THE INVENTION

Accordingly, it is a general object of the present invention to provide a laboratory apparatus for a wet treatment of textile materials which produces realistic and reproduceable results.

A further object of the invention is to provide a laboratory apparatus in which the conveying unit comprises a pump having a rotating pumping means for generating a non-pulsating flow of the treatment liquid of which pumping means the sense of rotation is reversable whereby the flow in the flow passage can be reversed.

Another object is to provide a laboratory apparatus by means of which a exactly defined flow pass can be arrived at in the area of the textile material being treated which flow can be reversed within desired time intervals and in which the dead volume or dead space, respectively and accordingly the base relationship may be held in realistic dimensions. This will allow of the production in the laboratory of a true and reduceable representation of a technically large scale treatment procedure.

Still a further object is to provide a laboratory apparatus in which the direction of rotation of the conveying pump allows a direction of flow through the material being treated mounted to a specimen carrier in radial direction from the inside towards the outside and additionally also in the opposite direction.

A further object is to provide a laboratory apparatus in which the design of the specimen carrier is such that the flow of the treatment liquid through the specimen being treated is also possible in an axial direction thereof from the bottom to the top or also from the top to the bottom.

Still a further object is to provide a laboratory apparatus in which the flow capacity can be substantially increased together with an improvement of the base relation such that it can correspond completely to the demands made in laboratories.

BRIEF DESCRIPTION OF THE DRAWING

The present invention will be more fully understood and objects other than those set force above will become apparent when consideration is given to the following detailed description thereof. Such description makes reference to the annexed drawings, wherein.

DESCRIPTION OF THE PREFERRED EMBODIMENTS

Figure 1:
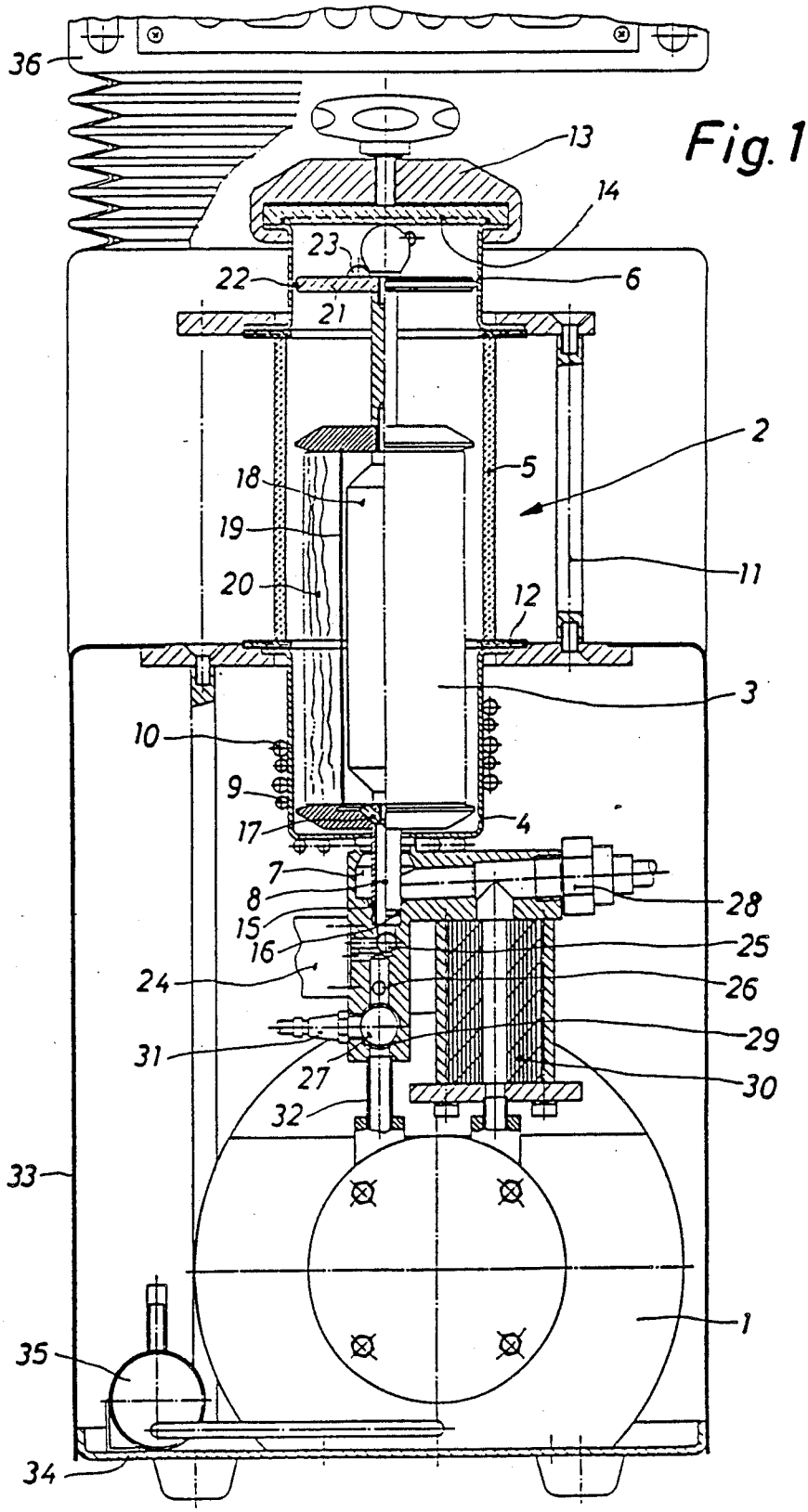
FIG. 1 is a longitudinal section through a first preferred embodiment of the inventive laboratory apparatus.

FIG. 1 illustrates a first embodiment of the laboratory apparatus for a wet treatment of textile materials which apparatus comprises basically a conveying unit 1 and a treatment chamber 2 which two structures are integrated to one structural unit. The apparatus further comprises a specimen carrier 3 located in the treatment chamber 2 and a exactly defined flow pass of the treatment liquid. The treatment chamber 2 is made up of basically three parts:

Firstly of a open topped cylinder 4 which is provided in the center of its bottom with two annular coaxially arranged openings for coupling with the feeding channel 7 and discharging, channel 8. The selected arrangement produces a flow characteristic in both radial directions of flow and which characteristic is extremely smooth. This cylinder is surrounded by heating or cooling, respectively coils 9,10 having a relatively small mass and extending at the side and at the bottom of the cylinder such that it is possible to achieve steep heating and chilling or cooling, respectively gradients with a low expenditure of energy.

The center part of the treatment chamber 2 comprises a transparent cylindrical intermediate piece 5 which is fixedly held by means of a tensioning device and which upon a simple loosening thereof can be pulled out laterally and exchanged respectively upon removal of the specimen carrier 3. The filling volume of the treatment chamber 2 can be adjusted by a suitable selection of a corresponding intermediate piece 5 which exchangeable intermediate pieces 5 have a constant height but varying diameters. A sealing system 12 secures the impeccable operation of this module - like arrangement. A cylinder 6 forms the upper part of the treatment chamber 2 which cylinder 6 is in turn closed at its upper end by a cover 13 having an integrated steam protection arrangement. The lower side of the cover 13 is provided with an edge 14 producing a defined forming of droplets.

Upon an opening of the cover 13 the specimen carrier 3 can be removed. By means of its lower tube-like designed end 15 the carrier 3 is positively centered in a specimen carrier receiving part. At the same time this tube shape section forms the inner flow channel 8 and is sealed against the outer channel 7 by means of a seal 16.

The treatment liquid exits the feeding channel 8 through an annular opening 17 from (or in case of a opposite flow is aspirated thereinto) and is urged by a displacement body 18 towards a specimen drum 19 having perforations and flows smoothly through the prevailing specimen 20 wound thereupon.

At its upper end the specimen carrier 3 is provided with a disk shaped closure 21 which centers the specimen carrier by means of a guide ring 22 relative to the treatment chamber. A line (not illustrated) line extends from a overflow valve 23 through the cover 13 or cylinder 6 such to allow the overflow scavenging of the apparatus (see herebefore).

Upon interrupting the feed flow by means of a interrupting apparatus 24 the specimen being treated can be contacted by external mediums (e.g. cold water/steam) feed via an infeed line 25 without influencing the treatment liquid.

Further possibilities of influencing and monitoring the treatment operation are provided by a apparatus 26 for removal of liquid and an apparatus 27 for a defined adding of auxiliary materials.

The monitoring and controlling of the operation is supported, furthermore, by two pressure sensors 28, 29 in the feeding and discharging, respectively channels 7,8, a means for an inductive measurement of the magnitude of the through flow, a temperature sensor 31 and a bypass system 32 for the determination of the actual extract of colour from the treatment liquid by means of a colourmetric probe or sampling device, respectively.

The lower part of the apparatus is surrounded by a integral casing 33 which can be slipped over and removed from the fixedly mounted parts of the apparatus without a disassembling, which greatly facilitates maintenance operations.

At its bottom, the casing 33 is closed by a bottom plate 34 which is designed as collecting vat.

A cleaning and feeding or draining, respectively system 35 which is coupled to a pump allows a complete draining of the apparatus and impeccable cleaning thereof.

A pivotable control unit 36 is integrated in the coverhood of the apparatus.

Figure 3:
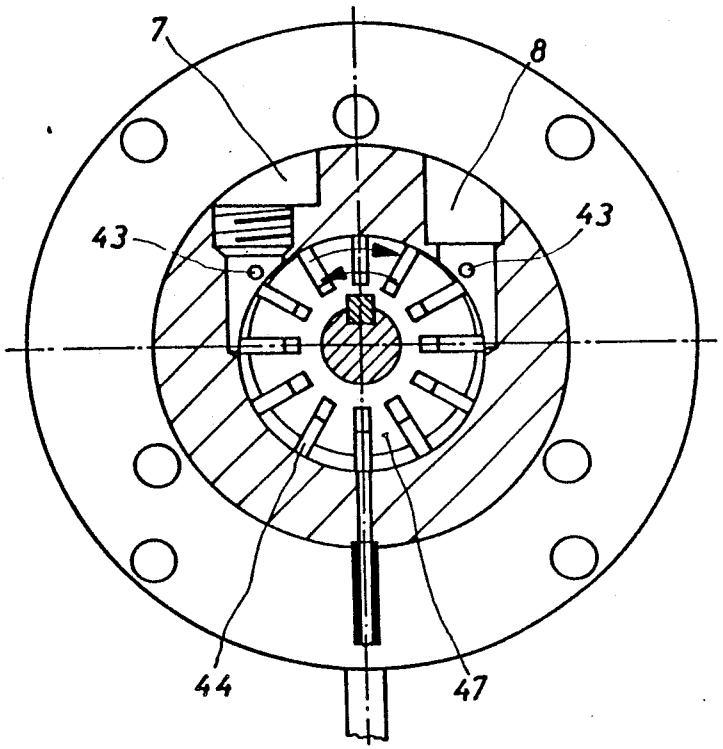
FIG. 3 is a view of a section extending perpendicularly to the axis of the conveying unit of FIG. 2.
Figure 2:
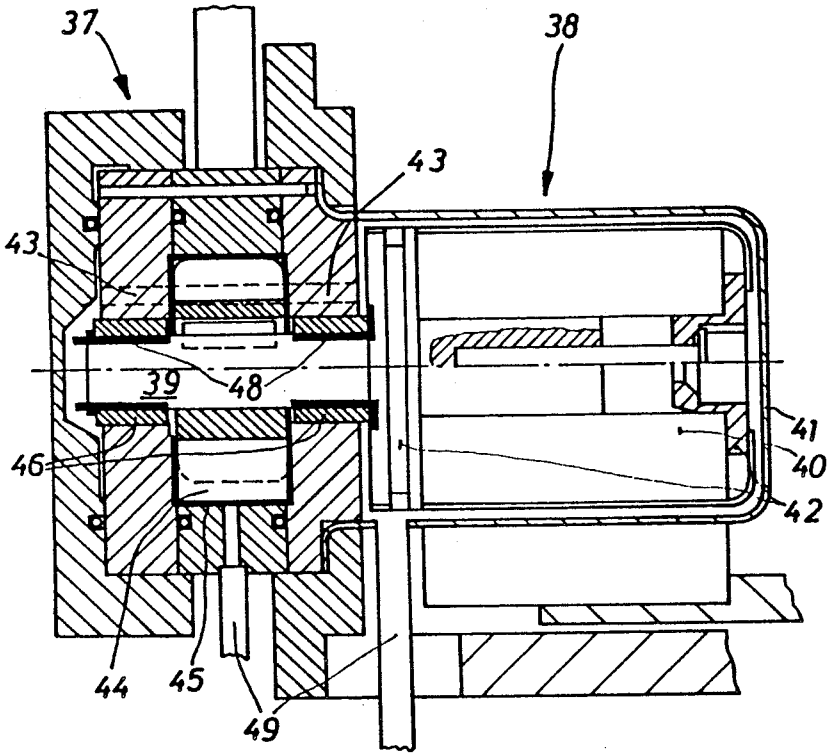
FIG. 2 illustrates an axial section through a conveying unit located in the apparatus illustrated in FIG. 1.

The conveying unit 1 comprises, as best illustrated in FIGS. 2 and 3, a rotary vane pump 37 and a motor 38 with a magnetic rotor which are interconnected via shaft 39. The permanent magnetic rotor 40 of the drive motor 38 is completely encased by a casing 41. It is driven by a rotating pot-shaped magnet located outside of the casing. Accordingly, the dead or clearance, resp. volume of the motor may be kept small and there is nothing that gives rise to sealing difficulties.

Due to the mounting of displacement bodies 42 the dead volume of the conveying unit is decreased still further.

The feeding and discharging, channels 7,8 are short circuited via through bores 43 through the drive space such that in case of a changing of the direction of feed a speedy pressure equalization is arrived at and accordingly no overloading of the drive motor is achieved.

In order to prevent a contamination of the treatment liquid by particles produced by wear of the vanes 44, the friction part 45, the roller or slider bearings 46, the rotor 47 as well as the bearing and mounting section 48 of the shaft 39 are provided with a layer of wear resistant and chemically resistant materials or fabricated of such materials (ceramic, glass, iron-chromium-nickel/-triboloy-basis alloys). The two openings 49 in the pumping and drive section are used for draining and cleaning.

Figure 4:
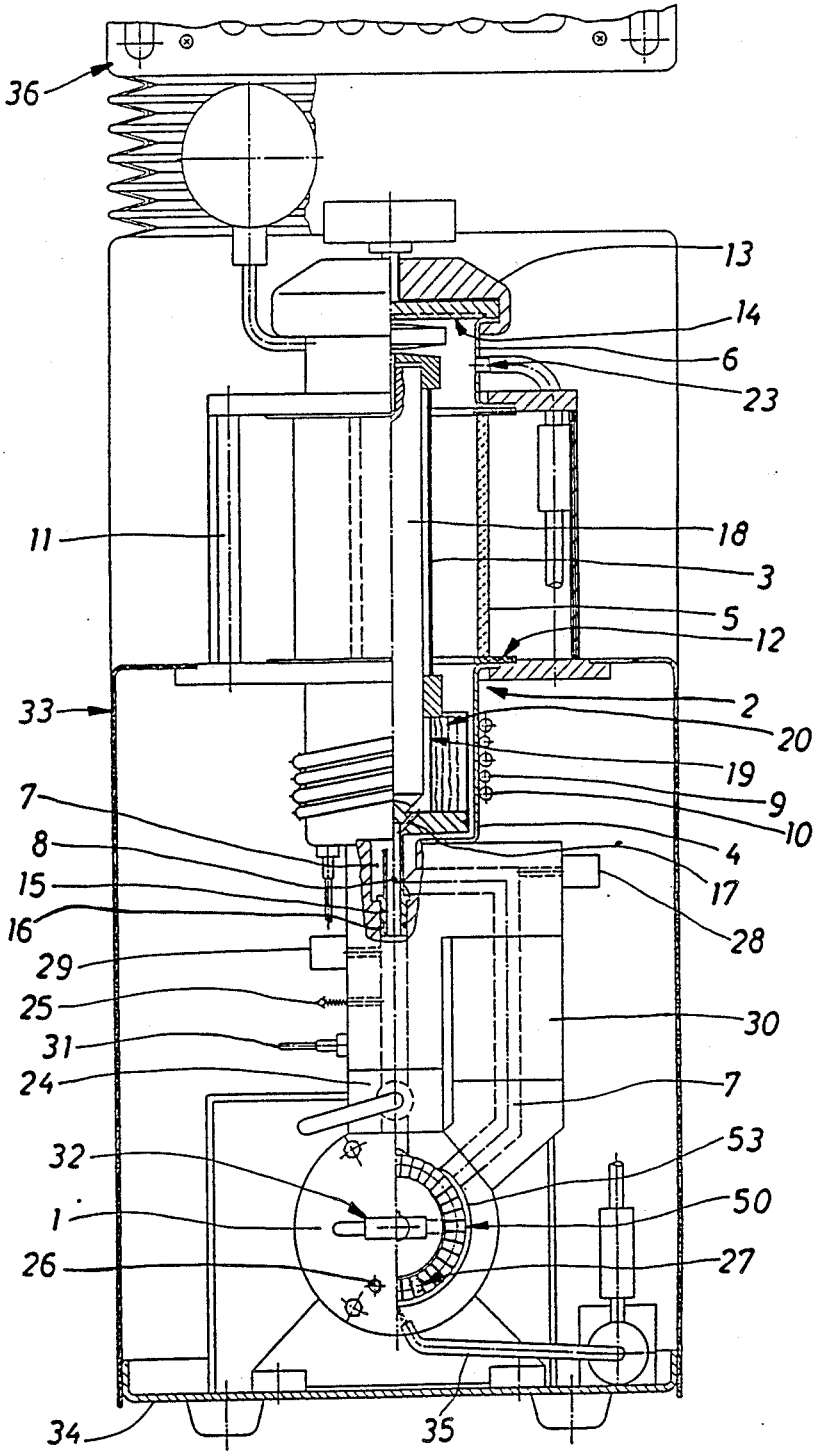
FIG. 4 is a longitudinal section through a second embodiment of the inventive laboratory apparatus.
Figure 5:
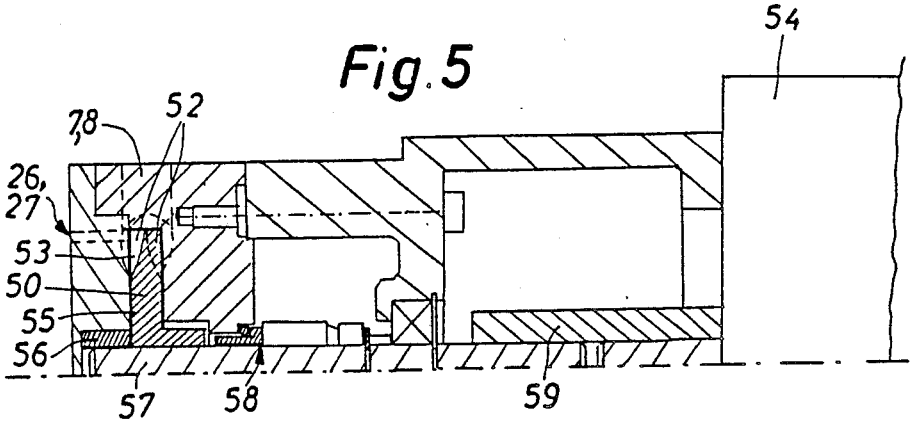
FIG. 5 is an axial section of the conveying unit of the embodiment illustrated in FIG. 4.

FIG. 4 illustrates a further embodiment of the invention which basically corresponds to the initially described embodiment with exception of the conveying unit 1. Accordingly, the description of the corresponding structures having the same reference numerals is not necessary. The conveying unit 1 has a design of a peripheral-wheel pump (see also FIG. 5). The peripheral wheel 50 comprises along its circumference lateral recesses 52 arranged staggered at the front and back side which recesses 52 cooperate with a pump channel 53. The feeding and discharging, respectively channels 7,8 open into this pump channel 53 (illustrated in FIG. 5 by broken lines). The peripheral wheel 50 can be rotated by a drive motor 52 in both senses of rotation such that the direction of feed can be reversed. The apparatuses 26,27 for the removal of liquid and the addition of auxiliary materials open directly into the pump channel 53, so as to secure an excellent distribution of such auxiliary materials in the treatment liquid. The same is true for the by pass system 32 for the determination of the actual colour extract from the treatment liquid. In order to prevent a contamination of the treatment liquid, the friction part 55 of the pump casing as well as the journal bearing 56 for the drive shaft 57 are covered by a layer of a chemical resistant material. At its exit out of the pump casing, the drive shaft 57 is sealed by a slide ring seal 58 and coupled to the motor shaft by a coupling 59.

The above description reveals that both embodiments incorporate pumps with a small dead or clearance volume which pumps operate reversably and impulse free and moreover can be excellently sealed also in case of aggressive treatment liquids. This allows an achieving of tests results which are close to actual practice and specifically are reproduceable in that controllable liquid flows can be generated.

Figure 6:
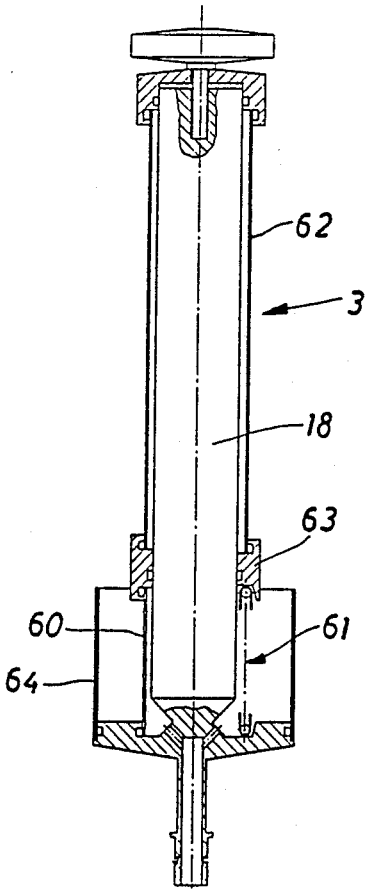
FIGS. 6 and 7 are sectional views of two specimen carrier sets removed from the apparatus.
Figure 7:
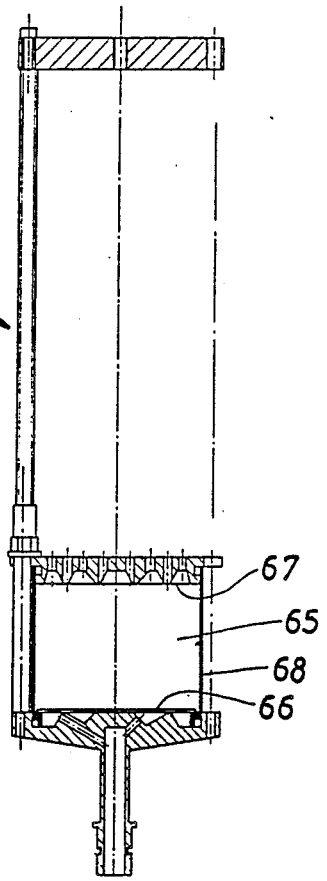

The design of the specimen carrier 3 such as illustrated in FIGS. 6 and 7 has the same object. The centrally and coaxially located feeding and discharging channels 7,8 lead to a smooth equal distribution of the flow inside the treatment chamber.

FIGS. 6 and 7 illustrate 2 specimen carrier inserts 3, which can be mounted selectively. The embodiment illustrated in FIG. 6 is intended for receipt of a textile roll having a rigid material specimen carrier bush 60 (at the left hand of the fig.) or a flexible material specimen carrier bush 61 having an adjustable height. The specimen carrier bush includes perforations for the through flow of the treatment liquid. It is supported by means of a closed distance holder tube 62 adapted to conform to the height of the respective bush and via a sealing ring 63. Accordingly the height of the roll (spool) can be accordingly selected by maintaining the same displacement body 18. A flow bush 64 which is open at its top is provided at the outside of the specimen supporting bush 60,61 which bush 64 extends roughly up to the height of the specimen carrier bush or the roll, respectively. Accordingly, the flow path of the treatment liquid is definitely defined. The returning of the flow from the central inlet 8 to the cylinder 4 does not proceed in and through the specimen roll but rather through the flow tube (see FIG. 4) such that less turbulances are generated which could lead to unwanted differences of the flow speed and temperatures, respectively through the roll of the specimen. The equal temperature distribution across the roll is generated further by a temperature exchange effect specifically in case of rolls having a large diameter or if the height of the roll extends above the directly heated height of the cylinder 4. The flow bush 64 is exchangeable and can be adjusted to the hight the roll. It secures an excellent reproduceabilty of the test results.

According to a alternative design the specimen carrier insert 3 may be structured as basket such as illustrated in FIG. 7. This basket 65 comprises at the bottom and at the top a perforated wall 66, 67 and is closed laterally by a bush 68 which defines a volume of the basket. The treatment liquid flows through the basket, that is through the textile material contained therein from the bottom to the top or vice-versa. Because the volume of the basket is set by the prevailing height of the bush a reproduceable density of the textile material is achieved. Differing volumes can be arrived at by a suitable selecting of the height of the bush.

By means of the laboratory apparatus described above, the apparatus is provided by means of which a broad range of tests can be covered by using a small member of exchange parts only. The flow and temperature conditions defined clearly at all applications allow to conduct tests having a excellent reproduceability and an exact realism.

Whilst there are shown and described present preferred embodiments of the invention, it is to be distinctly understood that the invention is not limited thereto but may be otherwise variously embodied and practiced within the scope of the following claims:

We claim:

1. A laboratory apparatus having minimal dead space for a wet treatment of textile materials, including a specimen carrier located in an exactly defined path of flow of a treatment liquid in a treatment chamber which in turn is integrated with a conveying unit for said treatment liquid into a structural unit, said conveying unit comprising a pump having a rotating pumping means comprising a rotary vane pump for generating a nonpulsating flow of the treatment liquid of which pumping means the sense of rotation is reversible whereby the flow in said path of flow can be reversed.

2. The apparatus of claim 1, in which the structural parts of the pump coming into contact with the treatment liquid consist or are covered by a layer of wear resistant and relative to the treatment liquid chemically resistant materials.

3. The apparatus of claim 1 and including treatment liquid feeding and discharge channels, in which said channels are short-circuited such to allow a equalization of pressure in said pumping means upon a reversal of the direction of flow.

4. The apparatus of claim 1, in which said conveying unit and said treatment chamber are interconnected by centrally and coaxially arranged feeding and discharge channels.

5. The apparatus of claim 4, in which said specimen carrier comprises a tube shaped end tip by means of which it is insertable and positively centered into said treatment chamber, which end tip forms simultaneously the end part of the inner of said coaxially arranged feeding and discharge channels.

6. The apparatus of claim 1, said specimen carrier comprising a specimen drum and an axis, which axis is widened at least at the area of said specimen drum to a displacement body whereby the clearance volume is reduced at least at said area of the specimen drum.

7. The apparatus of claim 1, said specimen carrier having a laterally perforated specimen supporting bush for receipt of a roll of textile material and in which said flow path extends through said supporting bush, comprising an open topped flow bush located coaxially to said specimen supporting bush and at the outside of said roll of textile material and whereby said flow path is guided around the outer side of said flow bush.

8. The apparatus of claim 1, in which said specimen carrier comprises a specimen basket limited at the bottom and the top by a perforated wall and at the side by a closed bush, and in which the volume of said specimen basket is adjustable by an appropriate selecting of the height of said bush, and whereby the flow path is directed vertically through said treatment specimen basket.

9. The apparatus of claim 1, in which a means for a direct colorimetric analysis of the treatment liquid is arranged in the circuit thereof.

10. The apparatus of claim 1, comprising heating and cooling coils located at the side and the bottom of said treatment chamber and contacting same directly.

11. A laboratory apparatus having minimal dead space for a wet treatment of textile materials, including a specimen carrier located in an exactly defined path of flow of a treatment liquid in a treatment chamber which in turn is integrated with a conveying unit for said treatment liquid into a structural unit, said conveying unit comprising a pump having a rotating pumping means comprising a peripheral-wheel pump for generating a nonpulsating flow of the treatment liquid of which pumping means the sense of rotation is reversible whereby the flow in said path of flow can be reversed.

12. The apparatus of claim 11, in which the structural parts of the pump coming into contact with the treatment liquid consists or are covered by a layer of wear resistant and relative to the treatment liquid chemically resistant materials.

13. The apparatus of claim 11 and including treatment liquid feeding and discharge channels, in which said channels are short circuited such to allow a equalization of pressure in said pumping means upon a reversal of the direction of flow.

14. The apparatus of claim 11 in which said conveying unit and said treatment chamber are interconnected by centrally an coaxially arranged feeding and discharge channels.

15. The apparatus of claim 14, in which said specimen carrier comprises a tube shaped end tip by means of which it is insertable and positively centered into said treatment chamber, which end tip forms simultaneously the end part of the inner of said coaxially arranged feeding and discharge channels.

16. The apparatus of claim 11, said specimen carrier comprising a specimen drum and an axis, which axis is widened at least at the area of said specimen drum to a displacement body whereby the clearance volume is reduced at least at said area of the specimen drum.

17. The apparatus of claim 11, in which a means for a direct colorimetric analysis of the treatment liquid is arranged in the circuit thereof.

18. The apparatus of claim 11, comprising heating and cooling coils located at the side and the bottom of said treatment chamber and contacting same directly.

* * * * *